United States Patent [19]

Wilkens

[11] 4,302,953

[45] Dec. 1, 1981

[54] RIGHT-RIGHT WARP KNITTING MACHINES

[75] Inventor: Christian Wilkens, Heusenstamm, Fed. Rep. of Germany

[73] Assignee: Karl Mayer Textilmaschinenfabrik GmbH, Obertshausen, Fed. Rep. of Germany

[21] Appl. No.: 60,740

[22] Filed: Jul. 25, 1979

[51] Int. Cl.[3] ..... D04B 23/02

[52] U.S. Cl. ..... 66/87; 66/88; 66/194

[58] Field of Search ..... 66/192, 196, 194, 195, 66/87, 88

[56] References Cited

U.S. PATENT DOCUMENTS

| | | | |
|---|---|---|---|
| 3,590,600 | 7/1971 | Kohl | 66/87 |
| 3,728,873 | 4/1973 | Titone | 66/87 |
| 3,855,820 | 12/1974 | Kohl | 66/87 |
| 3,921,418 | 11/1975 | Apken | 66/87 |

*Primary Examiner*—Ronald Feldbaum
*Attorney, Agent, or Firm*—Omri M. Behr

[57] ABSTRACT

A right-right warp knitting machine capable of providing pile fabrics such as velour includes two needle beds, each needle bed producing one fabric panel, utilizes one guide bar supplying a ground thread and at least a second guide bar for providing a pile thread. The panels may be connected together by a common thread which is cut after the completion of the fabric panels thereby forming two separate independent fabric panels having at least one velour surface.

10 Claims, 24 Drawing Figures

Fig. 12
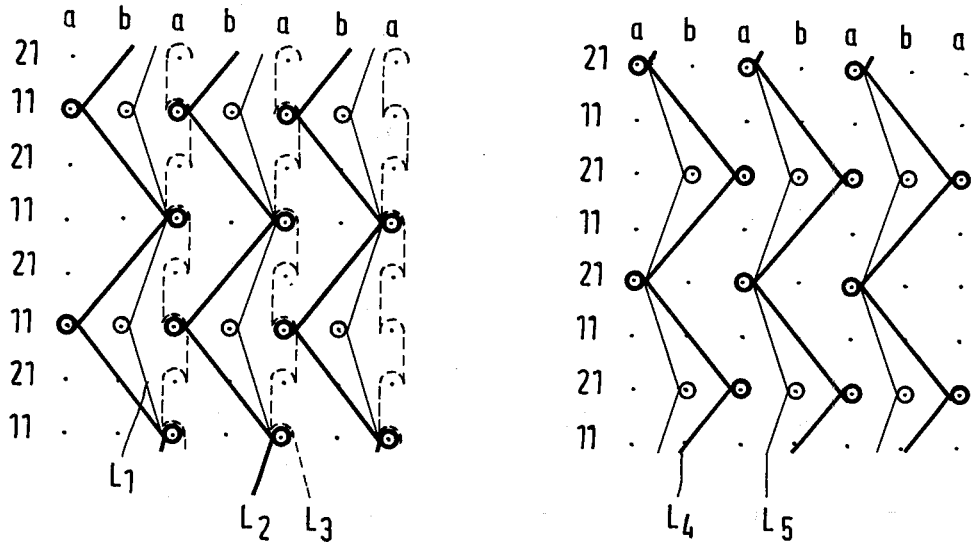
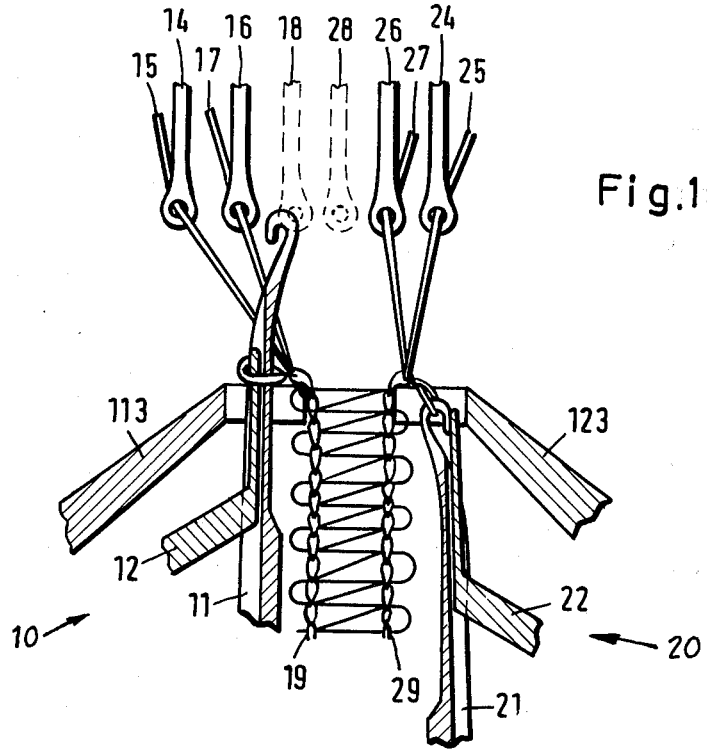
Fig. 15

RIGHT-RIGHT WARP KNITTING MACHINES

BACKGROUND OF THE INVENTION

1. Field of the Invention

The present invention relates to warp knitting machines, and in particular, to a warp knitting machine having two needle beds and a plurality of guide bars associated therewith for the forming of textured wear such as pile fabrics, velour fabrics and combinations thereof, or the like.

2. Description of the Relevant Art

In a warp knitting machine of the raschel type, such as that disclosed in U.S. Pat. No. 3,855,820 issued to Karl Kohl on Dec. 24, 1974, utilizing latch needles that are opened and closed by the threads it is possible to obtain one fabric panel for each needle bed when at least one ground thread guide bar and one pile thread guide bar alternately lay threads upon the needles of first one and then the other needle bed so that the pile threads in both fabric panels are knotted in. Thereafter the panels are separated with the aid of a knife, thus providing the pile or velour threads in two separate panels. This permits the manufacture of two fabric panels simultaneously, each having pile velour on the left side of the fabric.

Other types of knitting machines for the fabrication of loop pile fabric wears have been limited to the manufacture of a single fabric panel. These machines produced loop pile fabric by providing a bed of plush fingers on one side of the needle bed. In this type of machine the pile threads are alternately laid about a needle and a plush finger. This yields a fabric panel in which the pile loops are located only on the left side of the fabric. If it is desired to produce pile loops on both the left and right side of the fabric or on the right side of the fabric it is necessary to provide a plush finger bed on the other side of the needle bed.

Other warp knitting machines for the production of loop pile fabric which do not use a plush finger (sometimes called a point bar) are known. In this type of machine the ground thread for the production of fabric wear is laid over the even numbered needles while the pile thread is laid alternately about the even and about the odd numbered needles. The pile loops are thus bound into the even numbered needles and are knocked over from the odd numbered needles during the following work cycle. The needles are opened and closed by means of a presser bar. Thus, depending on the position of the guide bars utilized, pile loops are provided on the left side, on the right side or on both sides of the fabric wear. The height of the loops provided on the left side of the fabric are substantially dependent upon the spacing between the needles.

It is possible to produce a pile velour fabric material by the machines discussed hereinbefore, however it requires the cutting of the pile loops. In order to do this it is necessary to provide a separate cutting machine. However, utilizing this technique is costly since it results in a substantial loss of the expensive pile material. Furthermore, an additional disadvantage is present with this type of procedure, since the conversion of the pile loops into pile is not 100% efficient and some of the pile loops remain uncut.

Therefore, it is an object of the present invention to provide an arrangement for a warp knitting machine wherein loop pile fabric can be produced in greater varieties than heretofore.

It is a further object of the present invention to provide a warp knitting machine capable of providing pile fabric wear which combines loop pile and velour at various heights.

It is another object of the present invention to provide a warp knitting machine which can produce textured wear at substantially higher working speeds than presently in existence.

It is yet another object of the present invention to provide a warp knitting machine capable of providing fabric wear which may include pile loops and pile velour alternately or at the same time in the same fabric on one side thereof.

SUMMARY OF THE INVENTION

A process for manufacturing textured wear, such as, pile fabrics, velour fabrics and combinations thereof, or the like on a warp knitting machine, according to the principles of the present invention includes first and second needle beds having a plurality of needles requiring external closing means disposed thereon. Each needle bed producing a fabric panel. Also included are first and second closing means adapted to cooperate with the needles for opening and closing the needles in a predetermined time sequence. At least two first and two second guides are included. The guides lay thread about the needles in the first and second needle beds respectively. Alternatively, the first and second guides are swingable between the first and second needle beds as desired. The process comprises simultaneously laying a first thread about a first needle in the first and second needle beds by said first guides each working cycle for the formation of a stitch and periodically skipping the laying of a second thread about a second adjacent needle in the first and second needle bed by the second guides during the working cycle. The laying of a thread occurs in a predetermined sequence which may be controlled by a jacquard mechanism.

A right-right warp knitting machine for the production of pile fabrics, according to the principles of the present invention, comprises first and second needle beds having a plurality of needles requiring external closing means disposed thereon. Each of the needle beds produce a fabric panel. Additionally included are first and second closing means adapted to cooperate with the needles for opening and closing the needles in a predetermined time sequence. Additionally included are at least one ground thread guide bar and at least one pile thread guide bar associated with each needle bed. Each guide bar is capable of laying a thread about a needle in the first or the second needle bed. A thread is laid about a first needle in each needle bed in each working cycle for the formation of a stitch. A thread is laid about a second needle disposed between each of the first needles in each needle bed according to a predetermined pattern which may be controlled by a jacquard mechanism. Double faced warp knitting material according to the principles of the present invention includes wear which has a mixture of loop pile and velour on the same side thereof.

DESCRIPTION OF THE PREFERRED EMBODIMENTS

The warp knitting machine of the present invention utilizes a pair of needle beds having a plurality of compound needles affixed thereon. The needle beds are parallel, that is to say, a plane through the shanks of the needles in one needle bed is parallel to a plane taken through the shanks of the needles in the second needle bed. A thread is laid about the first needle, hereinafter referred to as the "a" needle in each needle bed in each work cycle to form a stitch. A second needle, hereinafter referred to as the "b" needle is disposed between each of the "a" needles on the needle bars and are utilized for the formation of the pile loops. However, the pile threads are not laid around the "b" needle on each cycle. The threads are laid about the "a" and "b" needles by conventional guide bars having a plurality of guides affixed thereon. Hereinafter, it will be understood that when the term guides or guide bar is used it refers to a conventional guide bar having a plurality of guides affixed thereon. Each of the needles in the needle bed have externally controlled closer elements, of the conventional type, and at least one pile thread guide bar is provided for each needle bar so that the pile threads are alternately laid on the first needle "a" of a given needle bed and then on a second needle "a" or "b" in the second needle bed.

A separate pile thread guide bar is provided for each needle bed so that it is possible for each needle bar to provide a pile fabric simultaneously. This enables pile loop wear to be produced at heretofore unattainable speeds. Thus, by using the externally controlled closing elements for the needles, instead of using latch needles which must be opened and closed by the threads, it is possible to produce pile loops by forming pin holes on the second needles.

Utilizing the present machine, it is possible to produce a large number of different types of pile fabrics with a large pattern variety which required the use of many different machines heretofore. A manufacturer is not required therefore to operate separate independent machines to get the various pattern varieties and is able to save considerable time and money by using a machine fabricated in accordance with the principles of the instant invention. The instant warp knitting machine is capable of laying at least one pile thread by a guide bar on a first needle of one needle bar and then move to a second needle on the other guide bar. In this manner, it is possible to provide both fabric panels with pile loops not only on the right side but also by choice or at the same time on the left side of the panel. Furthermore, there is an increased freedom of choice in the height of the pile to be provided on the left side of the panels. In addition, it is possible to lay at least one pile thread alternately about a first and a second needle in the same needle bed. In this way both fabric panels can move together the same amount without any interference between the two, which permits an increase in speed of operation of the machine.

Moreover, when at least one pile thread guide bar is utilized to lay a thread alternately about a first needle of one needle bed and about a first needle in the other needle bed it is possible to obtain, after cutting to separate the pile threads connecting the two panels, two fabric panels which have a pile velour on the left side. In addition, since loops have been provided on the right side, it is possible to produce a pile velour on the other side by sharing it in the conventional way.

Utilizing the instant warp knitting machine it is also possible to lay at least one pile thread alternately about a first needle in one guide bar and in a predetermined time sequence about a first needle on the other needle bed and during the remaining time about a second needle in the first needle bed. In this manner it is possible to obtain material which will have, on its left side, alternately pile loops and pile velour without losing any pile material through the cutting procedures. The distance between the two needle beds may be varied to increase the height of the velour or pile loops. In this manner, when the pile threads are laid alternately on the needles of one needle bar and then the needles of the other needle bar one may obtain a variation in the height of the pile loops when compared to threads that are laid about needles placed proximate to each other.

A further variation may be obtained when at least two pile thread guide bars make different pile loops during the same working cycle about the same second "b" needles. Thus, at least two pile thread guide bars can be provided to lay threads about different needle beds. This multiple utilization permits an increase in the number of pile loops without raising the number of needles utilized.

The warp knitting machine disclosed in U.S. Pat. No. 3,855,820 utilizes a latch-type needle which requires no externally controlled closing elements. Slider-type needles have, of course, been known but they have never been used with right-right warp knitting machines as in the instant invention. The use of a controlled closing mechanism provides a process wherein the pile threads can be knocked off every second working cycle. If one were to utilize latch needles during the step of knocking over the pile loop, the needle would close but it would not be possible to open it again. Therefore, using a slider needle with an external closing means as disclosed in the instant invention, permits fabric wear heretofore unknown to be produced. Furthermore, warp knitting machines utilizing two needle beds have heretofore been constructed with non-parallel needle beds that is to say, a plane through the shanks of the needles in each needle bed would be angled towards each other.

In the description of the preferred embodiment there are at least two guide bars that are driven by a common drive means at the same speed and which serve the different fabric panels. Generally, the same type of fabric will be knitted on both needle beds, therefore a considerable simplification in the construction of the warp knitting machine can be made with a common drive source for each of the fabric panels running at the same speed.

Preferably, the needles are provided with sliding closers. Therefore, there is no need to provide external steering means for the needle closing elements above the steering elements for knocking over the stitches, for example, presser bars and the like. With this extra space available it is possible to provide two ground thread guide bars and two pile thread guide bars above the knockover arrangement. Moreover, it is possible to provide additional guidebars so that more than one ground thread and more than one pile thread may be utilized for each fabric panel.

With the arrangement of the instant invention it is also possible to operate a warp knitting machine having compound needles and parallel needle bars with knockover sinkers that can accommodate two or three guide bars without difficulty. In addition, the guide bars may be coupled to a jacquard mechanism for steering the pile threads in order to provide a very large variety of patterns in both fabric panels. Materials may be provided for many different uses for example carpets, terrycloth, upholstery and the like.

BRIEF DESCRIPTION OF THE DRAWINGS

In order that the invention may be more fully understood it will now be described, by way of example, with reference to the accompanying drawing in which:

FIGS. 3 through 14 are a pictorial representation of twelve different lapping diagrams for the fabric panels shown in FIGS. 2(*a* through *m*); and FIG. 15 is a pictorial representation of the working area of an alternate embodiment of a right-right warp knitting machine, in accordance with the principles of the present invention.

DESCRIPTION OF THE PREFERRED EMBODIMENTS

Figure 1:
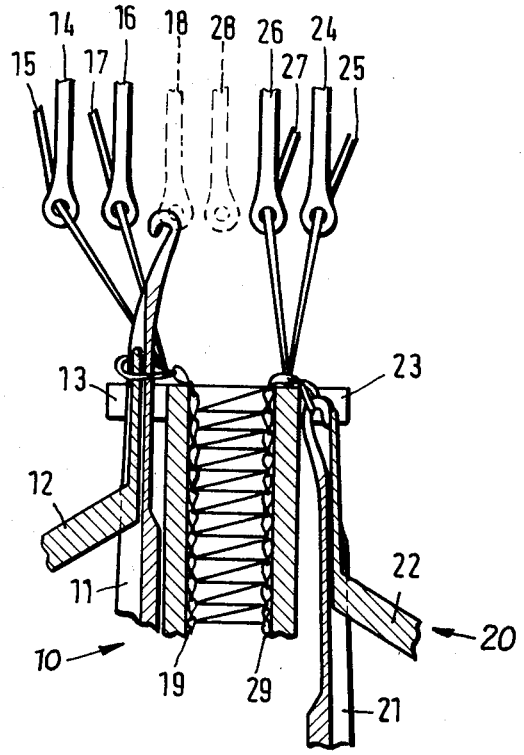
FIG. 1 is a pictorial representation of the working area of a right-right raschel warp knitting machine, in accordance with the principles of the present invention.

Referring now to the figures, and in particular, to FIG. 1, which shows in cross-section the working area of a right-right raschel warp knitting machine that includes a forward needle bed 10 with needles 11 affixed thereon, in a conventional manner, and a rearward needle bed 20 having needles 21 affixed thereon, in a similar manner. Needles 11 and 21 are provided with sliders 12 and 22 respectively which are moved by a mechanism, not shown, to open and close the hook of the needles. The needles 11 and 21 are disposed between knockover tricks 13 and 23, respectively.

The needle 11 is provided with a guide bar not shown having guides 14 affixed thereto in a conventional manner. The guide 14 provides the ground threads 15 which are laid about the needle 11. In a similar manner a guide bar, not shown, having guides 24 affixed thereon, provides the ground threads 25 which are laid around the needles 21. An additional guide bar is provided, not shown, having guide 16 affixed thereto, which provides an additional thread 17 that is laid, in accordance with a select pattern, around forward needles 11 or rearward needles 21. An additional guide bar, not shown, with guides 26 affixed thereon can furnish an additional thread 27 which similarly may be laid across the rearward needle 21 or the forward needle 11. Additional guide bars and guides may be provided for additional ground or pile threads. Thus, further guides such as 18 and 28 shown in dotted lines in FIG. 1, may be included to provide additional pile threads. In this manner, it is possible to provide two fabric panels 19 and 29 from ground threads 15 and 25, respectively. The fabric panels 19 and 29 may be provided with pile loops or pile velour in accordance with the manner described herein with the aid of pile threads 17 and 21.

Figure 2:
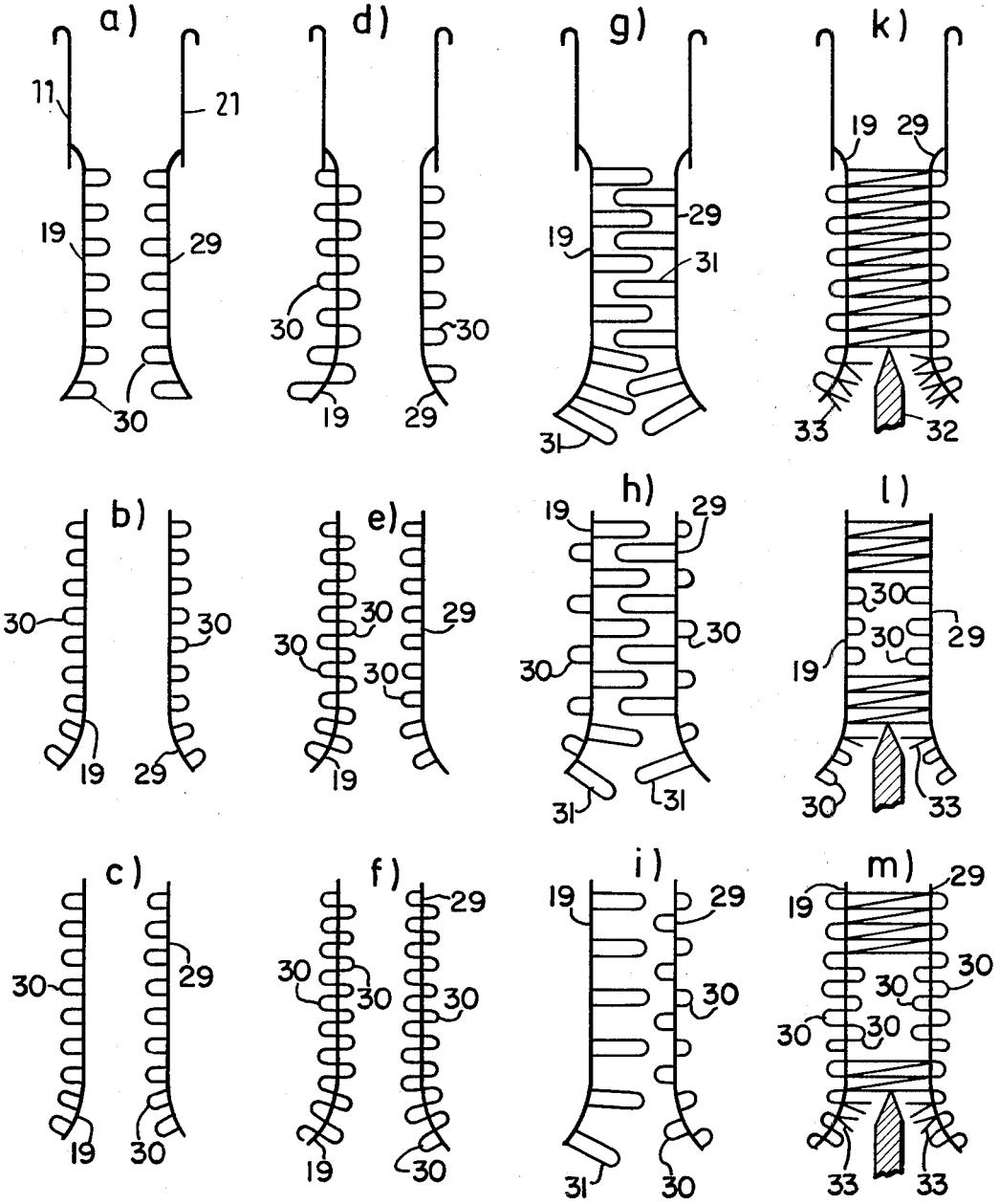
FIG. 2 is a pictorial representation of twelve different examples of the fabrication of two fabric panels in accordance with the present invention.

In FIGS. 2(*a* through *m*) there is disclosed a pictorial representation of a number of examples of the type of fabric panels that can be provided. Both of these fabric panels 19 and 29, shown in FIG. 2(*a*) are provided with a loop pile on the left side. In illustration 2(*b*) the fabric panels 19 and 29 are provided with loop piles on the right side. In FIGS. 2(*a*) and 2(*b*) the panels 19 and 29 are provided with small pile loops 30. As shown in illustration 2(*c*) the fabric panels may be provided with pile loops 30 on the right side of the forward panel 19 and on the left side of the rearward panel 29.

In FIG. 2(*d*) there is illustrated a fabric panel with a forward panels provided with small pile loops on both the right and left sides while the rearward panel is provided with pile loops only on the right side (FIG. 2(*d*)), only on the left side (FIG. 2(*e*)), and on the right and left sides (FIG. 2(*f*)).

In the panels described in FIGS. 2(*a* through *f*) the fabric panels 19 and 29 have guides 16 and 18, as well as 26 and 28 associated therewith, always working on the needles 11 and 21, respectively.

In the fabric panels to be discussed in FIGS. 2(*g–m*) the pile thread guide bars 16 and 18; and 26 and 28, alternately cooperate with the needles on the forward and on the rearward needle beds. In FIG. 2(*g*) there are provided large pile loops 31 on the left side of both fabric panels 19 and 29. In illustration 2(*h*) there is additionally provided small pile loops on the right side of each fabric panel 19 and 29. In FIG. 2(*i*) the forward panel 19 is provided with large pile loops 31 on the left side thereof and small pile loops 30 are provided on both sides of the rearward fabric panel 29.

The illustration shown in FIG. 2(*k*) shows small pile loops on the right side of each fabric panel with large pile threads on the left side of both panels linking both fabric panels together. The fabric panels 19 and 29 must be cut apart by a centrally disposed cutting blade 32 in order to provide a pile velour 33 on the left side of both panels 19 and 29.

FIG. 2(*l*) illustrates a pair of fabric panels 19 and 29 which includes a mixture of both pile velour 33 and pile loops 30 obtained on the same surface of each panel. The amount of velour obtained versus the amount of pile loops may be adjusted to create a desired pattern.

The illustration in FIG. 2(*m*) shows a combination of both the foregoing situations which includes pile loops occurring on the left and right sides of both panels with a velour occurring on the left side of both panels; the velour being obtained with the aid of a cutting blade 32 severing the pile threads which link both panels 19 and 29 together.

Figure 3:
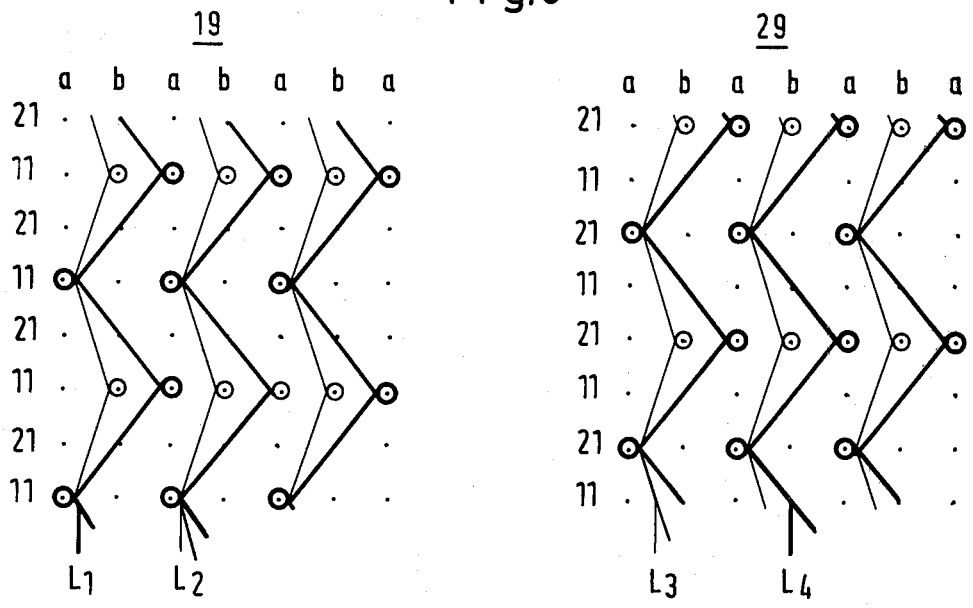

FIG. 3 shows the lapping diagram for the fabric panel illustrated in FIG. 2(*a*) the lefthand axis showing the needles 21 and 11, which are the rearward needles affixed to needle bar 20 and the forward needles affixed to needle bar 10, respectively, with "a" being the first needle in each needle bed and "b" being the second needle in the needle bed. The horizontal rows show the needles represented by a dot and correspond to the needles shown in FIG. 1 as 11 and 21. In the columns one may differentiate between the first needles "a" which are laid about during every working cycle of this particular needle bed and the needles "b" lying therebetween which are not lapped about during each working cycle for the formation of pile loops. The guide bars which have the guides fixed thereon are designated (from front to rear) $L_1$, $L_2$, $L_3$, and $L_4$. The thickened lines illustrated in the drawing shows the movement of the ground thread which is controlled by the guide bars $L_1$ and $L_4$ that carry the guides 14 and 24 respectively, as shown in FIG. 1. The thin lines show the movement of the pile threads controlled by guide bars $L_2$ and $L_3$ which carry guides 16 and 26, as shown in FIG. 1. In the fabric panel 19 the ground threads are seen to be laid alternately around neighboring first needles "a" in the forward needle bar 10 having needles 11 affixed thereon so that a tricot stitch is formed. The pile threads on the other hand are laid alternately about a first needle "a" affixed in needle bar 10 with needles 11 thereon whereby they are bound in by the ground thread and around a second needle "b" in the same needle bar, thus forming a pin hole and thereby forming a pile loop. Similarly, with respect the fabric panel 29 the ground stitch is laid alternately around neighboring first needles "a" in the needle bar 20 that has the needles 21 affixed therein and the pile thread is laid alternatiely about a first needle "a" and about a second needle "b" in the same needle bar.

Figure 4:
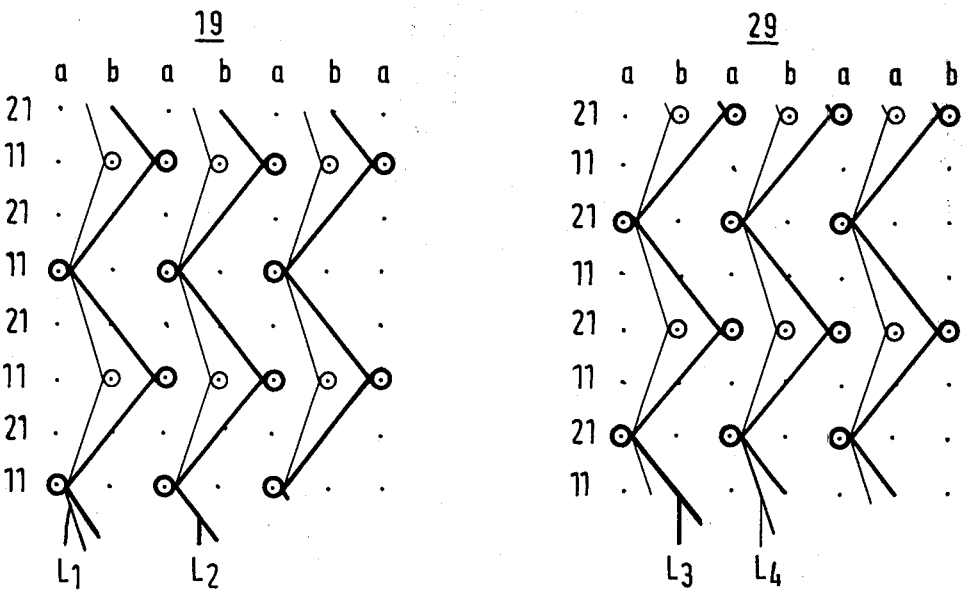

FIG. 4 shows the lapping diagram for a pair of fabric panels according to FIG. 2(*b*). It is differentiated with respect to FIG. 3 in that the guides controlled by guide bars $L_2$ and $L_3$ carry the ground threads and the guides controlled by guide bars $L_1$ and $L_4$ carry the pile threads. As a consequence thereof there is formed a tricot stitch in both fabric panels 19 and 29 which brings about the formation of pile loops on the right side of the fabric.

Figure 5:
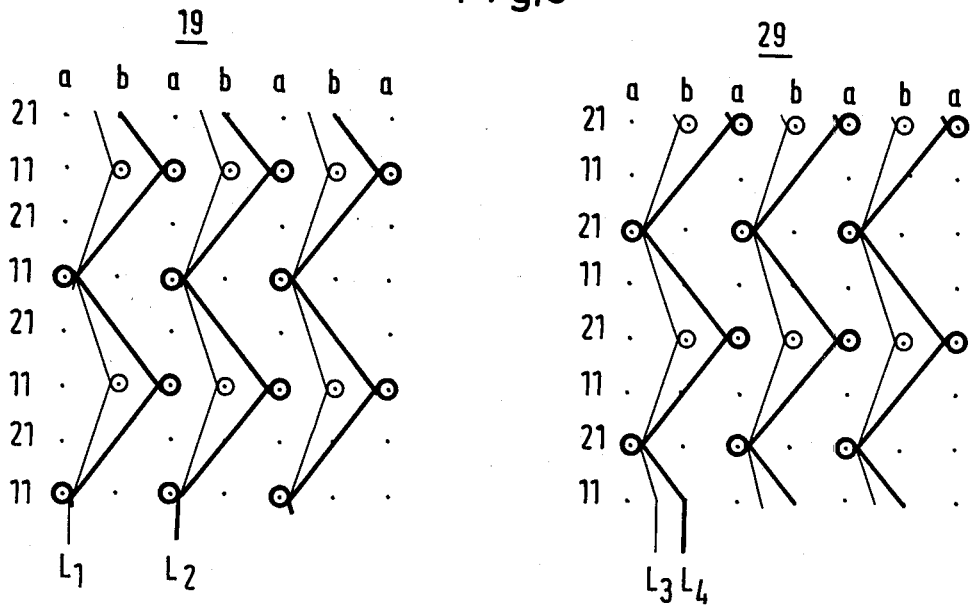
Figure 6:
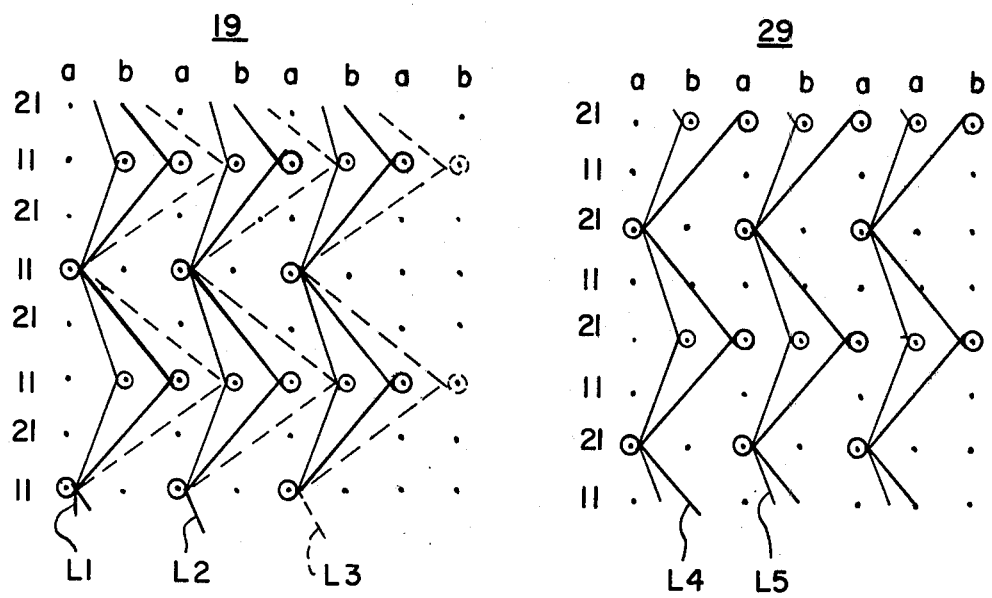

The lapping diagram of FIG. 5 corresponds to FIG. 2(*c*). This may be differentiated from FIG. 3 in that (as seen from the front) the second and fourth guide bars $L_2$ and $L_4$ carry the ground threads and the first and third guide bars $L_1$ and $L_3$ correspondingly carry the pile threads whereby there is provided pile loops on the right side of fabric panel 19 and on the left side of the fabric panel 29. FIG. 6 shows a lapping diagram with the fabric patterns in accordance with FIG. 2(*d*). Five guide bars are provided in this embodiment and are designated from front to rear (back), $L_1$ through $L_5$. A guide bar $L_2$ and a guide bar $L_4$ lay the ground thread, while the guide bars $L_1$ and $L_5$ each lay a first pile thread for the outwardly directed nap. The guide bar $L_3$ lays the second pile thread for the inwardly directed nap of fabric panel 19.

Figure 7:
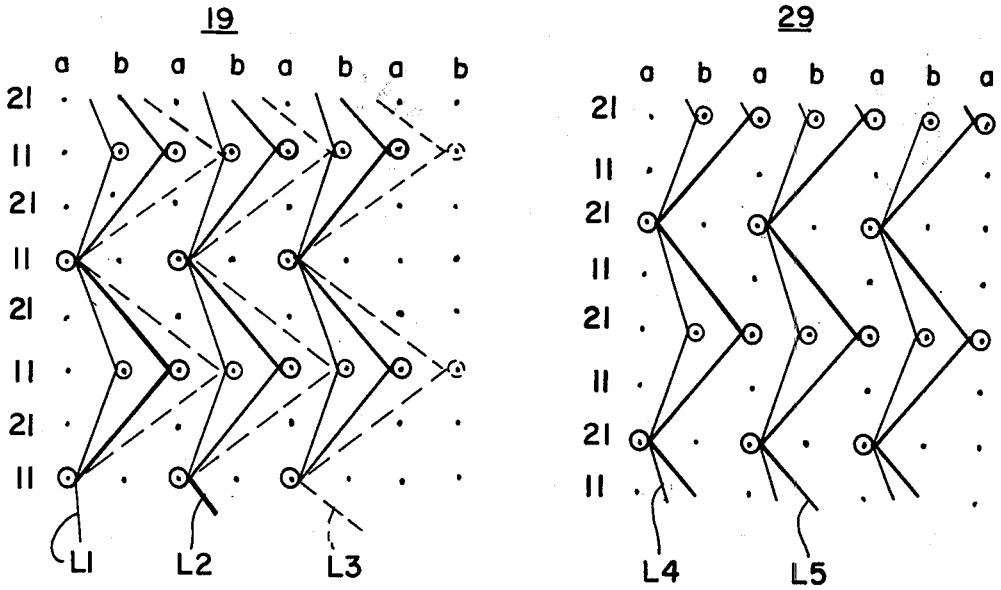

FIG. 7 shows the lapping diagram for a fabric material in accordance with FIG. 2(*e*). Again, five guide bars $L_1$ through $L_5$ are utilized. The guide bars $L_2$ and $L_5$ lay the ground threads while the guide bars $L_3$ and $L_4$ each lay a first pile thread for the inwardly directed pile loops and the guide bar $L_1$ lays a second pile thread for the outwardly directed pile loops of the fabric panel 19.

Figure 8:
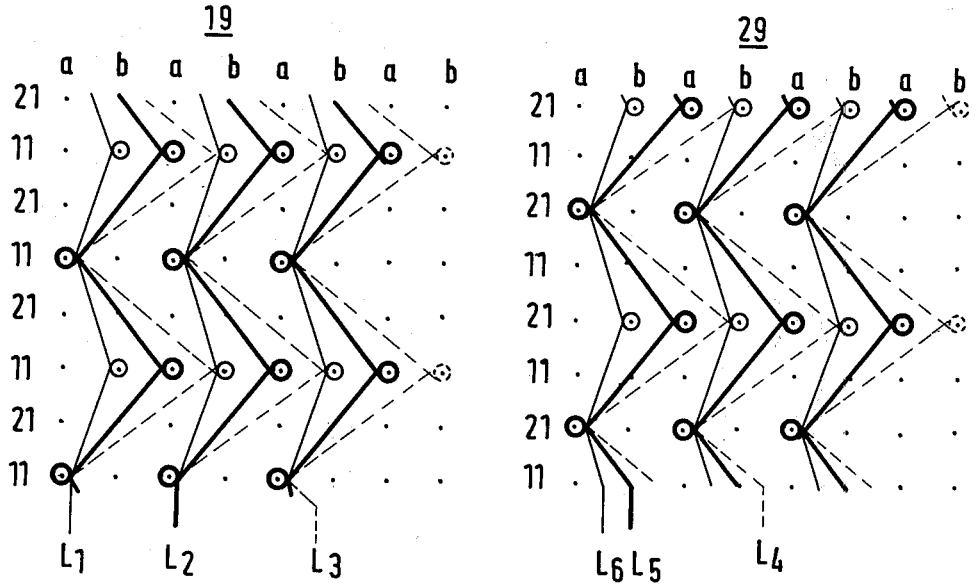

FIG. 8 shows the lapping diagram corresponding to FIG. 2(*f*). Here six separate guide bars utilized. From front to rear they are designated $L_1$ through $L_6$ The guide bars $L_2$ and $L_5$ carry the ground threads. Guide bars $L_1$ and $L_6$ carry a first pile thread and the guide bars $L_3$ and $L_4$ each carry a second pile thread. From a practical point of view, this corresponds with the arrangement of FIG. 4 with the addition of the dotted lines for the guide bars $L_3$ and $L_4$ as indicated. The pile threads are laid alternately about a first and second needle which is separated from each other by three spaces. Because of this there is provided correspondingly larger pile loops on the right side of both fabric panels. Thus, the second or "b" needles in the needle bed is used twice, that is to say, have two pile threads knitted about them.

Figure 9:
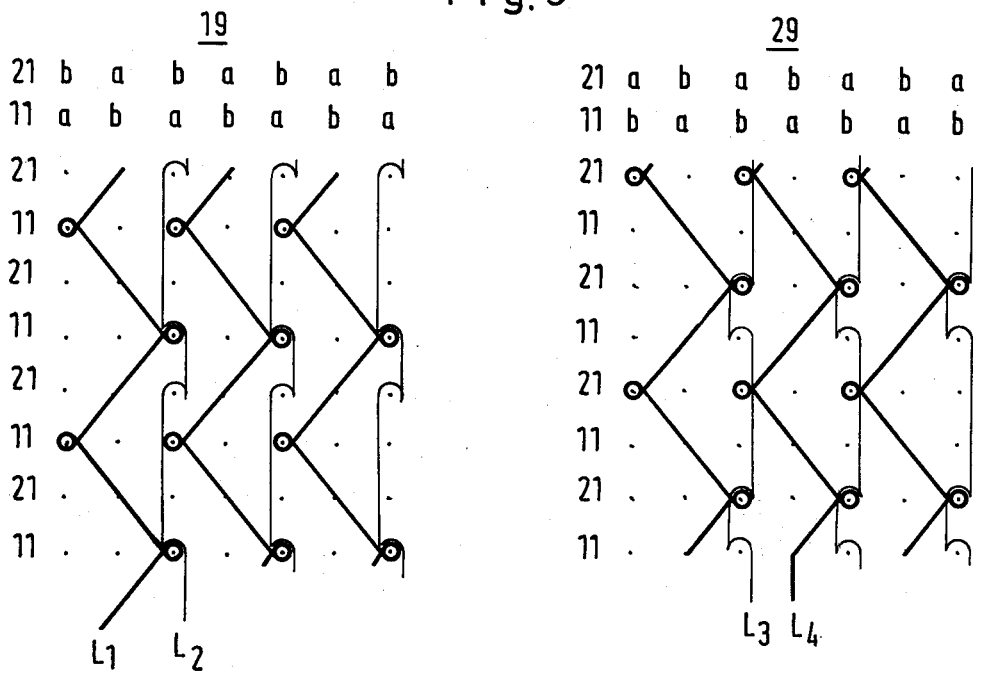

FIG. 9 shows a lapping diagram for a material corresponding to FIG. 2(*g*). In this lapping diagram we are concerned with the first or "a" needle of needle bed 11 and the second or "b" needle of needle bed 21 and vice versa. As indicated in the two uppermost descriptive portions of the figure, the first and fourth guide bars $L_1$ and $L_4$ lay the ground threads and form the tricot stitch. The guide bar $L_2$ in this case, in an open stitch, lays a pile thread alternately about a first needle "a" on the first needle bed and a second needle "b" on the second needle bed. In a similar manner, the guide bar $L_3$ lays the pile thread alternately about a first needle "a" on the rearward needle bed and about a second needle "b" in the forward needle bed. In this manner it is possible to provide substantially larger pile loops on the left side of the panels.

Figure 10:
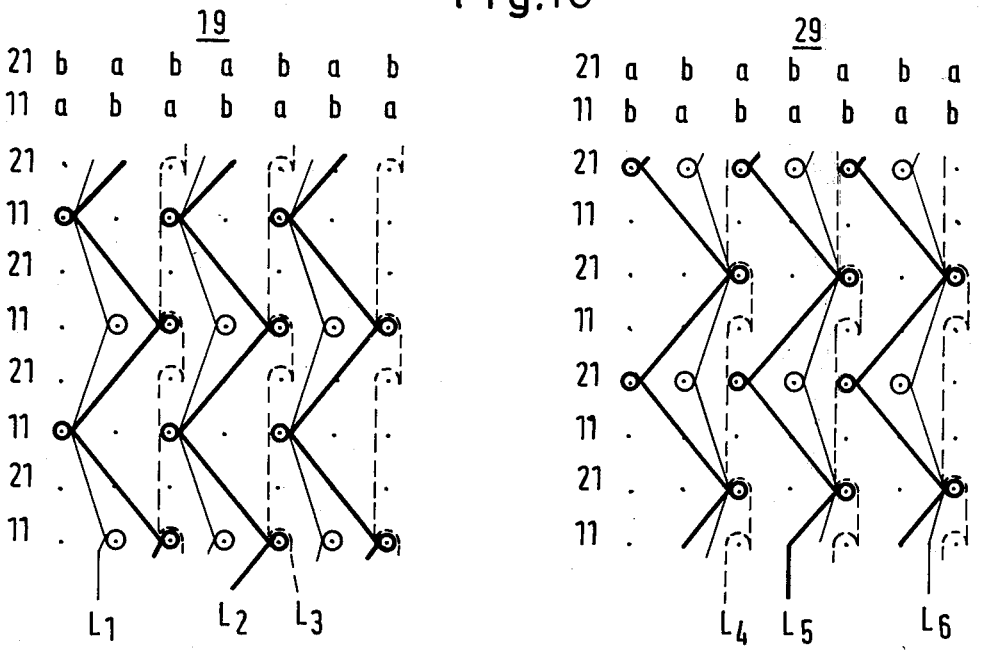

FIG. 10 shows a lapping diagram corresponding to FIG. 2(*h*) with a needle arrangement in accordance with FIG. 9. This time there are six guide bars of which, as viewed from the front, the second and fifth guide bars, $L_2$ and $L_5$ lay the ground threads in a tricot stitch, pile thread guide bars $L_1$ and $L_6$ produce pile loops on the right side, as is shown in accordance with FIG. 4. Pile thread guide bars $L_3$ and $L_4$ produce large pile loops on the left side, as is shown in accordance with FIG. 9.

Figure 11:
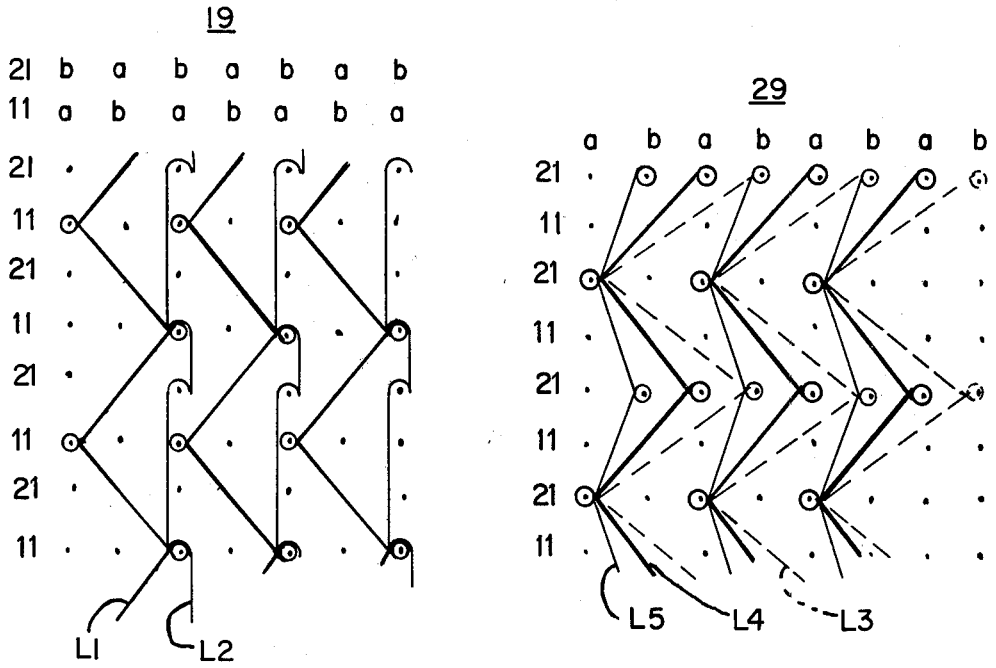

FIG. 11 shows the lapping diagram for a pair of panels in accordance with FIG. 2(*i*). Needle "a" of needle bed 11 is placed opposite a needle "b" of needle bed 21 and vice versa. with needle "b" of needle bed 11 positioned opposite to needle bed "a" of needle bed 21. The first and fourth guide bars $L_1$ and $L_4$ lay the ground threads in a tricot stitch. The guide bar $L_2$ lays a pile thread alternately on the first needle "a" of needle bed 11 and a second needle "b" of needle bed 21. This leads to comparatively large pile loops on the left side of the fabric panel 19. The guide bars $L_3$ and $L_5$ lay pile threads with the second fabric panel 29 in comparatively small loops on the left and right side of this fabric panel.

FIG. 12 shows a lapping diagram for FIG. 2(*k*). Here five guide bars $L_1$ through $L_5$ are utilized. The guide bars $L_2$ and $L_4$ lay the ground threads in a tricot stitch. The guide bars $L_1$ and $L_5$ produce pile loops on the right hand side of the fabric. Guide bar $L_3$ lays a pile thread alternately about the first needle "a" of needle bed 11 (the forward needle bed) and about a first needle "a" of needle bed 21 (rearward needle bed) so that the pile thread in each working cycle is knotted to each fabric path by the ground threads thereof. The last named pile thread is cut with knife 32 in order to separate both fabric panels 19 and 29.

Figure 13:
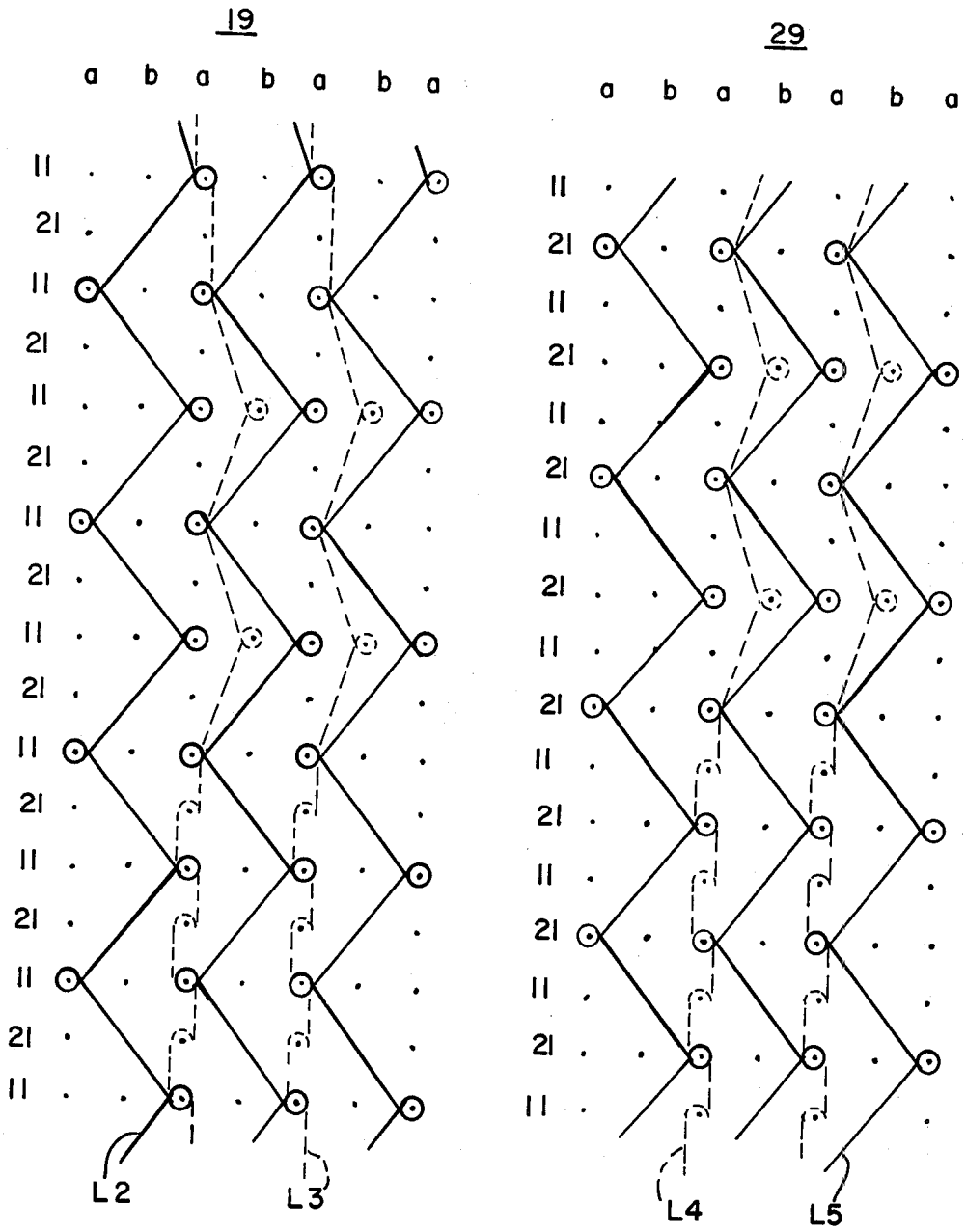

FIG. 13 shows a lapping diagram corresponding to FIG. 2(*l*). Guide bars $L_2$ and $L_5$ lay the ground thread. The guide bars $L_3$ and $L_4$ lay the pile threads which in the upper portion of FIG. 13 show the inner directed nap while in the lower part of FIG. 13 the threads are bound up alternately on the first and second needle beds.

Figure 14:
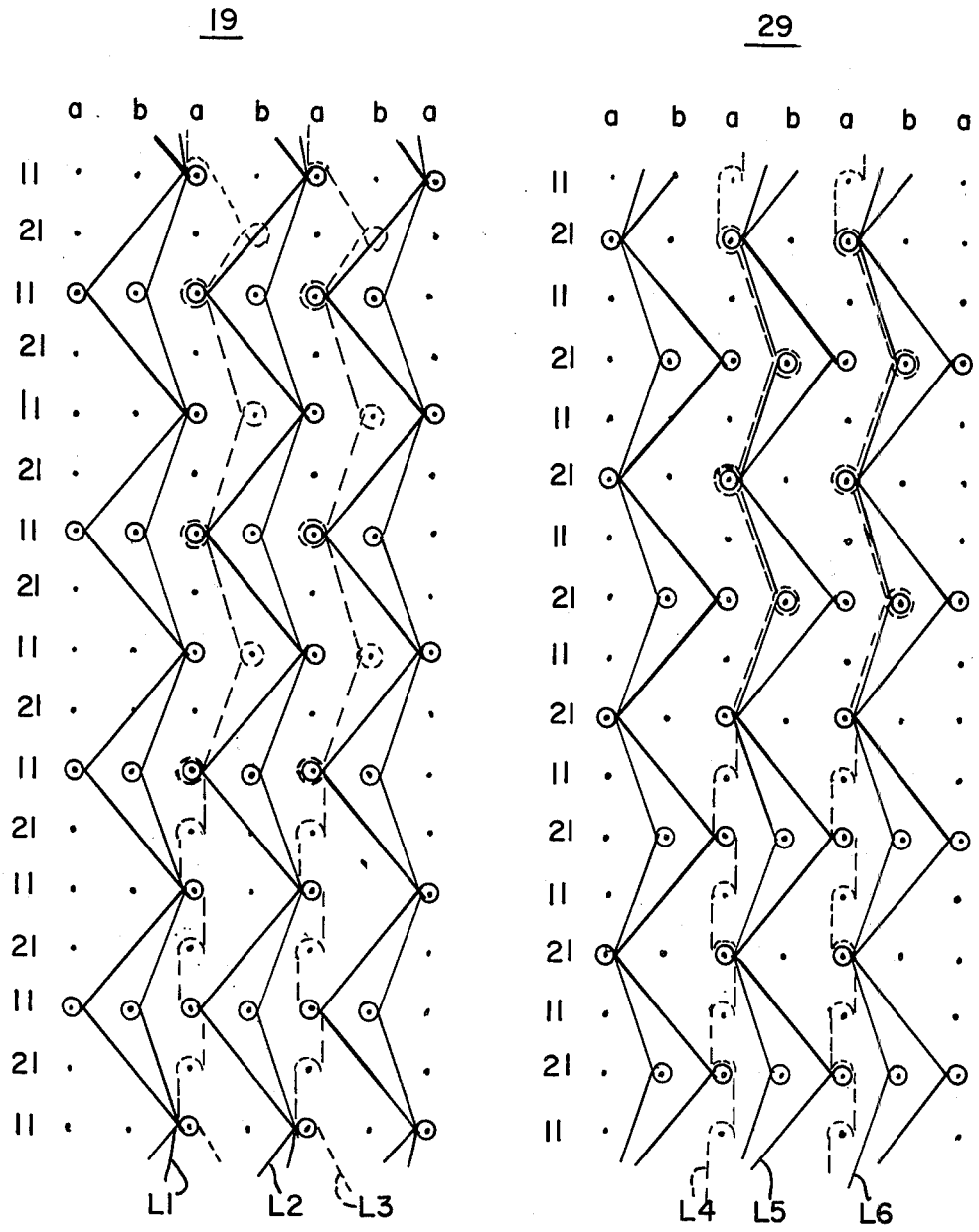

FIG. 14 shows the lapping diagram in accordance with 2(*m*). In this embodiment guide bars $L_2$ and $L_5$ lay the ground threads. Guide bars $L_1$ and $L_6$ carry the pile threads for the formation of outwardly directed small pile loops. The guide bars $L_3$ and $L_4$ carry the pile threads, which in the upper portion of the figure lead to the production of inwardly directed small pile loops and in the lower portion are alternatively bound off on the first and second needle beds.

In the foregoing drawings, only very simple lapping arrangements are shown for the ground and pile threads. However, utilizing the hereinbefore described warp knitting machine far more complicated lapping can be produced wherein the ground thread guide bars are displaced over several needle gaps or in which additional threads can be bound in. The basic fabric can be produced from a single thread or a system with a plurality of ground threads and with different lapping combinations, can be produced either as a stable or as a highly elastic fabric. The pile threads can be knotted in as the stitch or as a weft. The height of the pile loops can be chosen with comparative freedom. On the left side there can be produced, as desired, short or long pile loops by means of a displacement movement of the pile thread guide bars over several needle spaces or by means of the setting of distance between the two needle bars.

It is particularly to be noted that a large number of combinations in the proposed lapping patterns are possible, for example, there is produced a material in accordance with FIG. 2(*m*) where the lapping diagram of FIG. 8 and the lapping diagram of FIG. 12 are combined in sequence.

FIG. 15 shows a right-right warp knitting machine having the same numerical designation for components as are used in FIG. 1. While in the known warp knitting machines having two rows of bearded needles affixed in a needle bed the needle shafts are angled toward each other at an angle approximating 45°. This causes a limited amount of room for the guide bars. If one adapts a conventional warp knitting machine to utilize parallel needle beds with compound needles and knockover sinkers there is provided sufficient room in the area of the needle bed to provide four or more guide bars. The knockover sinkers have the advantage over the knockover tricks that a better and longer pile loop formation is possible. In place of using the illustrated slider needles other mechanically steered needles may be utilized such as compound needles or latch needles with self-opening latches. The knockover tricks 113 and 112 shown in FIG. 15 have generally the same construction as the knockover tricks 13 and 23 shown in FIG. 1. However, they are inwardly directed in FIG. 15 whereas in FIG. 1 they are outwardly directed. With the knockover tricks being inwardly directed as shown in FIG. 15 the goods 19 and 29 are pulled off over the free end of tricks 113 and 123 thus permitting more versatility and providing more room in the space beteen the forward and rearward needle beds 10 and 20.

Hereinbefore has been disclosed a right-right warp knitting machine which is capable of providing an almost infinite variety of textured wear and is capable of producing a pair of fabric panels simultaneously with mixtures of pile loop and velour occurring on the left side thereof. It will be understood that various changes in the details, materials, arrangement of parts and operating conditions which have been herein described and illustrated in order to explain the nature of the invention may be made by those skilled in the art within the principles and scope of the present invention.

Having thus set forth the nature of the invention, what is claimed is:

1. A process for manufacturing textured ware, such as pile fabrics, velour fabrics and combinations thereof, or the like on a warp knitting machine having first and second needle beds with a plurality of needles requiring external closing means disposed thereon, for producing a fabric panel on each said needle bed, first and second closing means adapted to cooperate with said needles for opening and closing said needles in a predetermined time sequence, and two first and two second guides for laying thread about said needles in said first and said second needle beds, respectively, comprising the steps of:

(a) simultaneously laying a first thread about a first needle in said first and second needle beds by said first guides each working cycle for the formation of a stitch; and (b) periodically skipping the laying of a second thread about a second adjacent needle in said first and second needle bed by said second guides during said working cycle the laying of said first and second threads occuring in a predetermined time sequence.

2. A process according to claim 1 further including the step of:

(c) using two thread guides to lay different loops during the same work cycle about the same second needle.

3. A process according to claim 1 further including the step of:

(e) providing said warp knitting machine needles with sliders as closers.

4. A process according to claim 1 further including, the steps of:

(f) providing said warp knitting machine needles with compound needles; and (g) providing said machine with knockover sinkers to cooperate therewith.

5. A process according to claim 1 further including the step of:

(h) controlling at least one of said guides by a jacquard mechanism.

6. A process for manufacturing textured ware, such a pile fabrics, velour fabrics, and combinations thereof, or the like on a warp knitting machine, having first and second needle beds with a plurality of needles requiring external closing means disposed thereon, for producing a fabric panel on each said needle bed, first and second closing means adapted to cooperate with said needles for opening and closing said needles in a predetermined time sequence, and two first and two second guides for laying thread about said needles in said first and said second needle beds, respectively, being alternatively swingable between said first and said second needle beds, comprising the steps of:

(a) laying a first thread about a first needle in said first and second needle beds by said first guides each working cycle for the formation of a stitch, leaving a second needle adjacent to said first needle free of said first thread; and (b) occasionally laying a second thread about said first needles and about said second needles in said first and said second needle beds by said second guides for tying off by said first needles by said first threads during said working cycle and being knocked off from said second needles in a later working cycle as a pile loop; said laying of thread occuring in a predetermined time sequence, said first threads providing the ground work of said panels and said second threads forming relatively small pile loops when laid across a second needle on the same needle bar.

7. A process according to claims 1, or 6 further including the steps of:

(i) forming said pile loops on the left side of said fabric panel.

8. A process according to claims 1, or 6 further including the step of:

(j) forming said pile loops on the right side of said fabric panels.

9. A process according to claims 1, or 6 further including the steps of:

(k) forming said pile loops on the left side of one of said panels and the right side of the other of said panels.

10. A process according to claims 1, or 6 further including the steps of:

(l) alternately swinging said needle guides between said first and said second needle beds and locking the thread carried by said needle guides to only one fabric panel; and (i) forming said pile loops on the left side of said fabric panels.

* * * * *